US009419369B2

(12) United States Patent
Drew et al.

(10) Patent No.: US 9,419,369 B2
(45) Date of Patent: Aug. 16, 2016

(54) PLUG-IN CONNECTOR, CONTROL APPARATUS AND METHOD FOR PRODUCING A CONTROL APPARATUS

(71) Applicant: CONTINENTAL AUTOMOTIVE GMBH, Hannover (DE)

(72) Inventors: Gregory Drew, Zeitlarn (DE); Thomas Riepl, Bad Abbach (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 14/400,033

(22) PCT Filed: May 7, 2013

(86) PCT No.: PCT/EP2013/059452
§ 371 (c)(1),
(2) Date: Nov. 10, 2014

(87) PCT Pub. No.: WO2013/167570
PCT Pub. Date: Nov. 14, 2013

(65) Prior Publication Data

US 2015/0140860 A1 May 21, 2015

(30) Foreign Application Priority Data

May 8, 2012 (DE) ..... 10 2012 207 601

(51) Int. Cl.
*H01R 13/40* (2006.01)
*H01R 13/52* (2006.01)
(Continued)

(52) U.S. Cl.
CPC ..... *H01R 13/5202* (2013.01); *H01R 12/585* (2013.01); *H01R 13/521* (2013.01); *H01R 13/5216* (2013.01); *H01R 13/5219* (2013.01); *H01R 13/665* (2013.01); *H01R 13/6658* (2013.01)

(58) Field of Classification Search
CPC ..... H01R 13/5202; H01R 13/521; H01R 13/665; H01R 13/5216; H01R 13/5219; H01R 12/585
USPC ..... 439/589, 936
See application file for complete search history.

(56) References Cited

U.S. PATENT DOCUMENTS 4,364,621 A 12/1982 Janvrin et al.
4,588,242 A 5/1986 McDowell et al.
(Continued)

FOREIGN PATENT DOCUMENTS

CN 101507375 A 8/2009
DE 202007012369 U1 6/2008
(Continued)

*Primary Examiner* — Khiem Nguyen
(74) *Attorney, Agent, or Firm* — Laurence A. Greenberg; Werner H. Stemer; Ralph E. Locher

(57) ABSTRACT

A plug-in connector for a control apparatus has at least one contact pin which passes through a base section of a support body of the plug-in connector and can be connected electrically and mechanically to a printed circuit board of the control apparatus. The support body of the plug-in connector has a trough, which is formed by the base section, a groove laterally surrounding the base section and a side edge laterally surrounding the groove. The trough can be filled with a sealing compound such that the compound extends within the trough integrally from the groove to the contact pin and covers the base section in certain places or completely. A control apparatus and a method for producing a control apparatus are also described.

14 Claims, 2 Drawing Sheets

(51) Int. Cl.
*H01R 12/58* (2011.01)
*H01R 13/66* (2006.01)

(56) References Cited

U.S. PATENT DOCUMENTS 5,993,233 A * 11/1999 Fukuda ..... H01R 43/005 439/271
7,641,616 B2 * 1/2010 Coulston ..... A41D 13/1281 600/490
8,292,639 B2 10/2012 Achammer et al.

FOREIGN PATENT DOCUMENTS

EP 0035378 A2 9/1981
WO 2008005945 A2 1/2008

* cited by examiner

PLUG-IN CONNECTOR, CONTROL APPARATUS AND METHOD FOR PRODUCING A CONTROL APPARATUS

BACKGROUND OF THE INVENTION

Field of the Invention

The present disclosure relates to a plug-in connector for a control apparatus. It also relates to a control apparatus, in particular for a motor vehicle, comprising a housing with an opening into which the plug-in connector is inserted, wherein the plug-in connector comprises at least one contact pin which passes through a base section of the plug-in connector and is connected electrically and mechanically to a printed circuit board arranged in the interior of the housing. In addition, the present disclosure relates to a method for producing a control apparatus.

This patent application claims the priority of the German patent application No. 102012207601.8, the disclosure content of which is herewith incorporated by backreference.

As a rule, a seal is inserted between the housing and the plug-in connector. This can be, for example, a seal which is prefabricated from a plastic material. To a certain extent there is a requirement to also seal the region of the plug-in connector through which the contact pins pass. For this purpose, for example in the past a seal has been applied to the inside of the plug-in connector. The application of this further seal is carried out before the assembly of the control apparatus at the manufacturer of the plug-in connector. In contrast, the provision of the seal between the housing and the plug-in connector takes place only when the components are assembled. This results in a complex fabrication sequence involving high costs.

BRIEF SUMMARY OF THE INVENTION

An object of the present invention is to specify a plug-in connector for a control apparatus with which an improved seal can be implemented in a particularly easy way.

This object is achieved by means of a plug-in connector and a method having the features of the independent patent claims. Advantageous embodiments and developments of the plug-in connector, of the control apparatus and of the method result from the dependent patent claims.

According to one aspect, a control apparatus is specified which is provided, in particular, for use in a motor vehicle. According to a further aspect, a housing for the control apparatus is specified. According to a further aspect, a plug-in connector for the control apparatus is specified.

The control apparatus preferably has the housing. The housing has an opening into which the plug-in connector can be inserted. In the finished control apparatus, the plug-in connector is inserted into the opening.

The plug-in connector has at least one base section and one contact pin. The base section is, in particular, a part of a support body of the plug-in connector, i.e. the support body has the base section. The contact pin runs through the base section of the plug-in connector. In the finished state of the control apparatus, the contact pin is connected electrically and mechanically to a printed circuit board arranged in the interior of the housing.

Expediently, the plug-in connector preferably has a circumferential groove which runs between a side boundary, running around the base section, and the base section of the plug-in connector. The groove is provided, for example, for accommodating a collar of the housing which runs around the opening of the housing. In particular, the groove, like the side boundary, runs around the base section in a plan view along a plug-in direction of the plug-in connector. The base section is preferably completely by the groove in the lateral direction. The groove is preferably completely enclosed in the lateral direction by the side boundary, running around the base section, of the plug-in connector. The side boundary forms, for example, an outer wall of the plug-in connector.

In the finished state of the control apparatus, in one embodiment an upper edge of the side boundary is located in an installation position higher than a surface of the base section facing the housing. In other words, an upper edge of the side boundary facing the interior of the housing is offset relative to a surface of the base section, facing the interior of the housing, in the direction of the interior of the housing.

In other words, in one embodiment the support body of the plug-in connector has a trough for holding the seal. The trough is formed by the groove, the base section and the side boundary. A surface of the base section, specifically the surface of the base section facing the housing, constitutes, in particular, a part of a base surface of the trough, and the groove can constitute a further part of the base surface of the trough. An opening of the trough lying opposite the base surface is expediently bounded by the upper edge of the side boundary. In one expedient embodiment, the contact pin projects from the base surface of the trough in the direction of the opening and preferably beyond the opening. The trough can be filled with a sealing compound, and in the finished state of the control apparatus is filled with the sealing compound. In this context, in one advantageous embodiment the sealing compound extends, in particular inside the trough, integrally from the groove to the contact pin in such a way that it covers the base section in certain locations or, preferably, completely and in particular encloses the contact pin laterally. In one expedient embodiment, the surface of the base section facing the housing is completely covered by the sealing compound in this way.

When the sealing compound is introduced in order to form the seal, the sealing compound therefore cannot run out of the plug-in connector even though it has viscous or fluid properties. Furthermore, this embodiment makes possible a situation in which the sealing mass only has to be applied to a single location of the base section of the plug-in connector. As a result, the manufacture can also be carried out easily and efficiently.

In this way, a first sealing interface is formed in the region of the opening between the housing and plug-in connector, in particular between the collar of the housing running around the opening and the side boundary of the plug-in connector running around the base section. A second sealing interface is formed on the base section in the region of the at least one contact pin, specifically, in particular between the base section of the support body and the contact pin. The first and second sealing interfaces are sealed by a seal which is of continuous or integral design and is formed, in particular, by the sealing compound with which the trough is filled.

This design provides the advantage that the two sealing interfaces can be sealed by means of a common seal which is generated in a processing step, in particular the filling of the trough with the sealing compound. This reduces the complexity of the manufacture of the control apparatus. As a result, said apparatus can be manufactured cost-effectively.

The seal is expediently formed in the region of the first and second sealing interfaces from the same material, in particular from the sealing compound. This also reduces the complexity of the manufacture of the control apparatus since it is possible to use just a single material to manufacture the seal. Nevertheless, a two-compound or multi-compound material can also be used.

The seal can be, for example, a hardening liquid seal. The liquid seal is, in particular, hardened in the finished state of the control apparatus. The liquid seal preferably has a certain degree of elasticity even in the hardened state. Suitable sealing compounds for manufacturing the hardened liquid seal are known in principle to the person skilled in the art and are therefore not explained in more detail at this point.

In one further embodiment, the collar of the housing which runs around the opening is arranged in the groove in the final-mounted, i.e. finished, state in which the plug-in connector is inserted into the opening in the housing.

In the final-mounted state, the upper edge of the side boundary of the plug-in connector is expediently spaced apart from the housing, at least in certain sections with the result that, in particular, an air-permeable gap or region is formed between the side boundary and the housing. Air which is displaced when the sealing compound is applied can advantageously escape through the air-permeable gap. This ensures that the sealing compound can be distributed freely in the groove of the plug-in connector into which the collar of the housing is inserted, as a result of which these two housing components are sealed with respect to one another.

The printed circuit board is expediently arranged or formed in the housing in such a way that in a mounting position above the opening in the housing an access to the plug-in connector, secured to the housing, is provided for applying the sealing compound onto the base section of the plug-in connector. For example, the base section is not covered by the printed circuit board in certain locations in a plan view of a main face of the printed circuit board. For example, the printed circuit board has a cutout through which the sealing compound can be applied to the base section. As a result, the seal can be manufactured when the plug-in connector and the housing are already mechanically connected to one another. As a result of the fluidity of the sealing compound it is ensured that the first and second sealing interfaces are reliably sealed. The arrangement or embodiment of the printed circuit board is provided in such a way that an access to the plug-in connector above the opening then permits the sealing compound to be applied.

In the method according to the invention for manufacturing the control apparatus of the type described above, in a first step a semi-finished product is made available, which semi-finished product comprises the plug-in connector which has been inserted into the opening in the housing. The semi-finished product is oriented in a subsequent step in such a way that the plug-in connector is arranged underneath the housing in the direction of gravity, with the result that the contact pins which are arranged in the plug-in connector, with which contact is to be made by a complementary plug from outside the control apparatus, point downward. Fluid sealing compound is then applied to the base section of the plug-in connector from the interior of the housing and through the opening, with the result that said plug-in connector runs into an intermediate space, formed in the groove between the collar of the housing and the wall of the groove, until finally the level of the base section is reached. In one expedient embodiment of the method, the application of the fluid sealing compound is continued until the sealing compound extends from the groove via the base section to the contact pin, with the result the sealing compound covers the base section in certain locations or completely and encloses the contact pin laterally.

An advantage of the method according to the invention is that a common seal can be used to seal the two sealing interfaces, which seal is not implemented until the final mounting of the control apparatus.

According to at least one aspect, a control apparatus is specified, in particular for a motor vehicle, which has a housing with an opening into which a plug-in connector is inserted. The plug-in connector has at least one contact pin which passes through a base section of the plug-in connector and is connected electrically and mechanically to a printed circuit board arranged in the interior of the housing. A first sealing interface is formed in the region of the opening between the housing and the plug-in connector, and a second sealing interface is formed on the base section in the region of the at least one contact pin. The first and second sealing interfaces are sealed by a seal which is of continuous or integral design.

According to at least one embodiment of this aspect, the plug-in connector has a circumferential groove which runs between a side boundary of the plug-in connector and the base section, wherein the side boundary forms, in particular, an outer wall of the plug-in connector. An upper edge, facing the housing, of the side boundary is offset relative to a surface of the base section facing the housing, in the direction of the housing.

The invention will be explained below in more detail on the basis of an exemplary embodiment in the drawing, in which:

DESCRIPTION OF THE INVENTION

Figure 1:
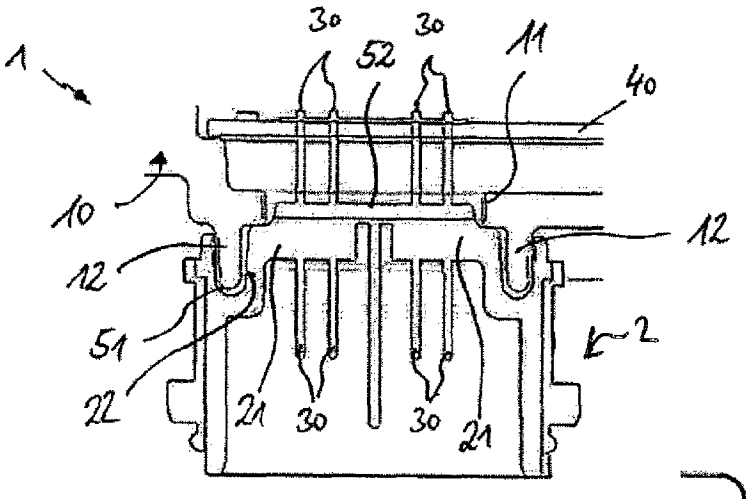
FIG. 1 PRIOR ART
FIG. 1 shows a partial cross-section through a conventional control apparatus.

FIG. 1 shows a control apparatus 1 which is known from the prior art, for example an engine or transmission control apparatus for a motor vehicle. Combined control apparatuses for an engine and transmission or other open-loop and closed-loop control functions of a motor vehicle are also conceivable. The control apparatus 1 has a housing 10, of which only a detail of a housing lower part can be seen in FIG. 1. The housing 10 has a base-side opening 11 into which a plug-in connector 2 is inserted, said plug-in connector 2 having contact pins 30 on a base section 21, said contact pins 30 passing through the latter.

Figure 2:
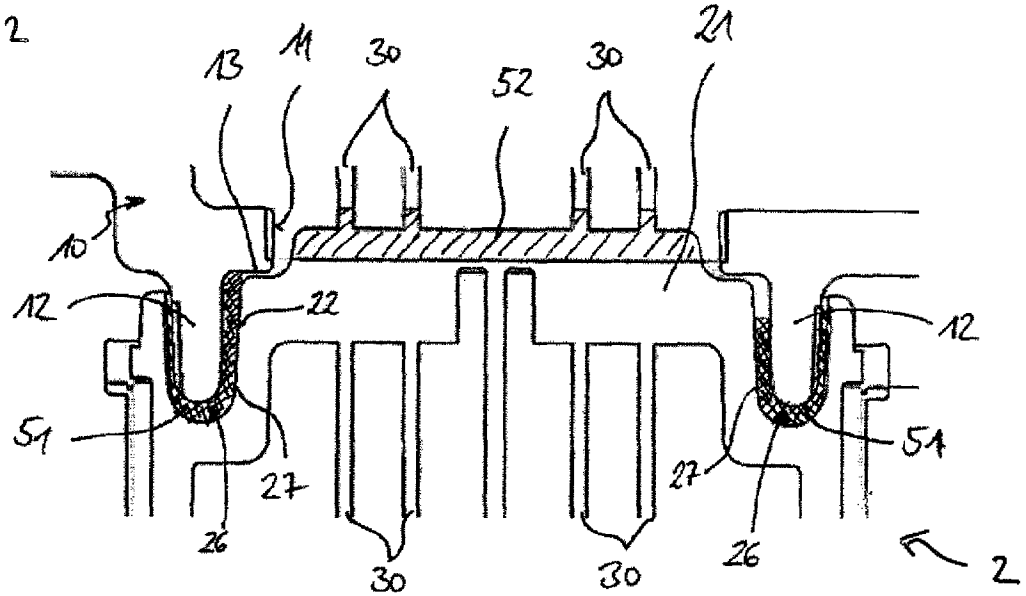
FIG. 2 PRIOR ART
FIG. 2 shows an enlarged illustration of the connecting region of a housing and of a plug-in connector of the control apparatus which is known from the prior art.

The connection which is formed between the housing 10 and the plug-in connector 2 is illustrated in enlarged form in FIG. 2. A seal 51 is illustrated between the housing 10 and the plug-in connector 2, in a groove 22 in the plug-in connector. This seal 51 may be a seal which is prefabricated from a plastic material, or may be a hardening liquid seal. The sealing material is introduced into the groove 22 before the process of joining the plug-in connector 2 to the housing 10.

In order to manufacture the mechanical connection, a collar 12 which surrounds the opening 11 is introduced into the groove 22, with the result that the material of the seal 51 which is not yet hardened is displaced. As a result, the intermediate space running between the collar 12 and the wall 27 of the groove 22, is filled with the material of the seal 51 and sealed. A shoulder 13 of the lower part of the housing is formed between the collar 12 and the opening 11. Within the scope of the manufacture, the shoulder 13 constitutes a stop for the plug-in connector 2 which is pressed in the direction of the opening 11 in the housing 10. The abutment of a base section 21 for the plug-in connector 2 against the shoulder 13 ensures in this known embodiment that the material of the seal 51 which is displaced through the collar 12, in the groove 22, cannot pass through the interior of the housing 10.

The region of the opening 11 between the housing 10 and plug-in connector 2 forms a first sealing interface. A second sealing interface is formed in the region of the contact pins 30, which penetrate the base section 21, in order to form electrical contact between a printed circuit board 40 arranged in the interior of the housing, and electrical and/or electronic components (not illustrated in FIG. 1). For this purpose, a further seal 52 is applied to the surface of the base section 21 facing the interior of the housing. The further seal 52 is generally applied by the manufacturer of the plug-in connector 2. This raises the costs of the plug-in connector 2.

Figure 3:
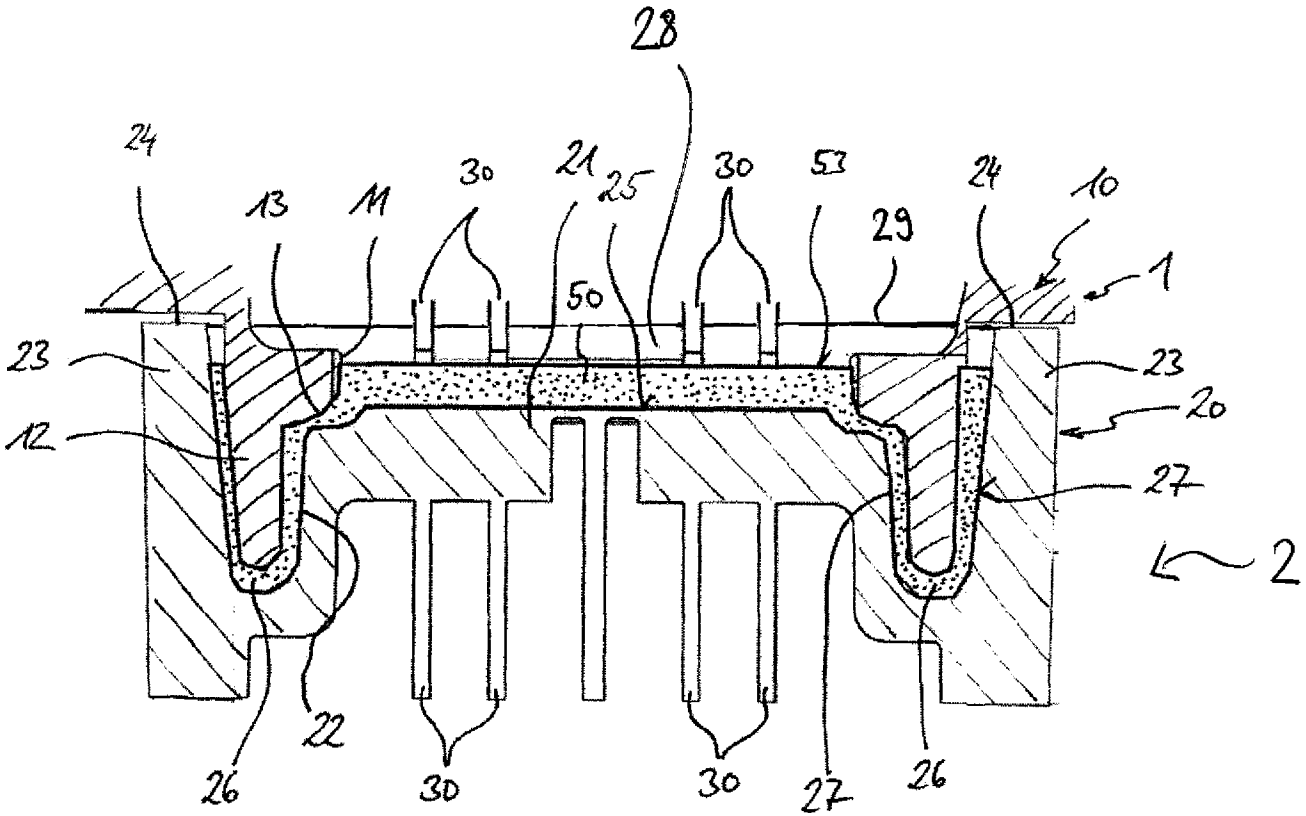
FIG. 3 shows a sectional view of the connecting region of a housing and of a plug-in connector of a control apparatus according to the invention.

The control apparatus 1 according to the invention which is illustrated partially in FIG. 3, has, in contrast with the above, the advantage that the first and second sealing interfaces are sealed by a seal which is of continuous or integral design, as a result of which a simplified manufacturing process is obtained. For example sa hardening liquid seal is used as the material for the seal which is characterized by the reference symbol 50.

The sealing of the first and second sealing interfaces by a seal which is of continuous or integral design requires a modified design of the plug-in connector 2 and of the housing 10 in the joint region in order to manufacture the mechanical connection.

The plug-in connector 2 has a support body 20 with a base section 21 and a side boundary 23, between which a groove 22 is formed. The groove 22 is embodied running around the base section 21 in a plug-in direction of the plug-in connector 2 in plan view, with the result that said groove 22 completely encloses the base section 21 of the plug-in connector 2 in the lateral direction. In the plan view, the side boundary 23 runs around the groove 22 in the plug-in direction, with the result that said side boundary 23 completely encloses said groove 22 in the lateral direction. In this way, a wall 27 of the groove is formed by the side face or faces of the side boundary 23 facing the base section 21.

FIG. 3 shows the control apparatus in its installation position or mounting position. An upper edge 24 of the boundary 23 is higher here in the installation position than a surface 25 of the base section 21 facing the housing 10. In other words, a trough 28 is formed in the support body 20 by means of the side boundary 23, the groove 22 and the base section 21, the base surface of which trough 28 is formed by a surface 25 of the base section 21 facing the housing 10, and by the groove 22. An opening 29, lying opposite the base surface, in the trough 28 is bounded by the upper edge 24 of the side boundary. The contact pins 30 project from the base surface 25 of the trough 28 in the direction of the opening 29 and preferably beyond the opening 29. The trough 28 can be filled with a sealing compound 50. In the finished state of the control apparatus 1, the trough 28 is filled with the sealing compound which is hardened for the seal 50. In this context, the sealing compound 50 extends integrally from the groove 22 as far as the contact pins 30, in such a way that it completely covers the surface 25 of the base section 21 facing the housing 10, and encloses the contact pins 30 in the lateral direction. In this context, the sealing compound 50 is preferably arranged completely within the trough 28 and, in particular, does not project beyond the opening 29 in the trough 28.

In this context, the composite (semi-finished product), composed of the housing 10 and the plug-in connector 2 is oriented in such a way that the plug-in connector 2 is arranged in the underneath the housing 10 direction of gravity. This means that the contact pins 30 which are arranged in the plug-in connector 2 and with which contact is to be made by a complementary plug (not illustrated) from outside the control apparatus point downward in the direction of gravity (and in the plane of the drawing.

As in the conventional control apparatus 1, the collar 12, which runs around the opening 11 in the housing 10, dips into the groove 22. In this context, an intermediate space 26 is formed between the collar 12 and the wall 27. Likewise, a distance from the base section 21 or the wall 27 of the groove 22 is provided in the region of the shoulder 13 of the opening 11, with the result that the intermediate space 26 is "connected" to the housing opening and therefore to the interior of the housing. Likewise, the upper edge 24 of the side boundary 23 does not abut against the housing 10, at least to a certain extent. Instead, the side boundary 23 is produced and arranged in such a way that at least one air-permeable gap or region is provided between the outer surroundings and intermediate space 26 in the interior of the groove 22.

In order to manufacture the seal 50, a mechanical connection is firstly formed between the plug-in connector 2 and the housing 10. For this purpose, the plug-in connector 2 is inserted into the opening 11 and secured mechanically to the housing 10, for example by means of latching projections or other securing means.

The mechanical connection of the plug-in connector 2 and housing 10 is preferably not formed until a printed circuit board (not illustrated in FIG. 3) with electrical and/or electronic components located thereon has been attached in the housing. At the same time as the manufacture of the mechanical connection of the plug-in connector 2 and housing 10, a contact pin 30 can be pressed into corresponding recesses in the printed circuit board in order to form an electrical connection with conductor tracks or electrical components formed on the printed circuit board. This is referred to as a press fit connection. In other embodiments, the electrical connection can be formed in other ways, for example by soldering.

The printed circuit board is arranged or formed in the housing 10 here in such a way that in the position shown in FIG. 3 above the opening 11 an access to the plug-in connector 2 which is secured to the housing 10 is provided for applying the sealing compound 50 onto the base section 21 of the support body 20 of the plug-in connector 2. This access may be, for example, an opening in the printed circuit board through which an application tool can be fed in order to apply the sealing compound 50 to the base section 21 of the plug-in connector 20, preferably in a central fashion.

Owing to the fluidity of the sealing compound 50 the latter firstly runs on the surface 25 of the base section 21 before finally flowing along the shoulder 13 into the intermediate space 26. In the process, the sealing material firstly flows downward in the intermediate space 26 on the inside of the wall 27 in the groove 22, in order that the intermediate space 26 is then forced upward again along the outer wall owing to the pressure conditions. When a static state is reached, an equal level of the sealing material with respect to the upper edge 24 of the side boundary 23 is established in the intermediate space 26 and on the base section 21. Since the position of the upper edge 24 of the boundary 23 is dimensioned in such a way that the latter is above an upper edge 53 of the seal

50 in the region of the base section 21, the sealing compound 50 cannot flow out over the edge 23 of the plug-in connector 20. In other words, the surface 25, facing the housing, of the base section, an exposed surface 53, facing away from the base section 21, of the seal 50, and the upper edge 24 of the side boundary 23 of the support body 20 follow one another in this sequence, in particular in a direction of the main extent of the contact pins 30, which is preferably at the plug-in direction. The seal 50 is arranged here completely inside the trough 28 and does not project through the opening 29 in the trough 28 into the interior of the housing.

As a result, a simultaneous seal of the first interface is brought about in the region of the opening between the housing 10 and the plug-in connector 20 as well as in the region of the second interface in the region of the contact pins 30 which pass through the base section 21.

In the control apparatus according to the invention, a seal can be formed between the housing and plug-in connector as well as in the region of the contact pins which pass through the plug-in connector, by means of a common seal which is of continuous and/or integral design. As a result, the control apparatus can be manufactured with less expenditure and therefore lower costs.

The invention is not restricted to the exemplary embodiments by virtue of the description thereof. Instead, the invention comprises any new features as well as any combination of features, which includes, in particular, any combination of features in the exemplary embodiments and patent claims.

The invention claimed is:

1. A plug-in connector for a control apparatus, the plug-in connector comprising:

a support body having a base section;

at least one contact pin extending through said base section of said support body and to be connected electrically and mechanically to a printed circuit board of the control apparatus;

said support body having a trough formed therein by said base section, a groove surrounding said base section in a lateral direction, and a side boundary surrounding said groove in the lateral direction; and sealing compound filling said trough, said sealing compound extending inside said trough integrally in one piece from said side boundary, through said groove and to said contact pin, and covering said base section at least in certain locations.

2. The plug-in connector according to claim 1, wherein said sealing compound covers said base section completely.

3. The plug-in connector according to claim 1, wherein said sealing compound is a hardening liquid seal.

4. A control apparatus, comprising:

a housing and a printed circuit board disposed in an interior of said housing, said housing having an opening for the plug-in connector according to claim 1 to be inserted, wherein the at least one contact pin of the connector is electrically and mechanically connected to said printed circuit board inside said housing;

a first sealing interface in a region of said opening between said housing and said plug-in connector, and a second sealing interface on said base section in a region of said at least one contact pin; and a seal formed integrally in one piece and sealing said first and second sealing interfaces, said seal extending inside said trough integrally from said groove to said contact pin and covering said base section at least in certain locations.

5. The control apparatus according to claim 4, wherein said seal covers said base section completely.

6. The control apparatus according to claim 4, configured as a control apparatus for a motor vehicle.

7. The control apparatus according to claim 4, wherein said seal in the region of said first and second sealing interfaces is formed from a common material.

8. The control apparatus according to claim 4, wherein an upper edge of the side boundary is offset relative to a surface of said base section facing said interior of said housing, in a direction of said interior of said housing.

9. The control apparatus according to claim 8, wherein said upper edge of the side boundary of the plug-in connector is spaced apart from said housing, at least in certain sections thereof.

10. The control apparatus according to claim 4, wherein said housing is formed with a collar running around said opening and said collar is disposed in said groove.

11. The control apparatus according to claim 4, wherein said printed circuit board is disposed or formed in said housing such that, in a mounting position above the opening, an access to the plug-in connector which is secured to the housing, is provided for applying a material of said seal to the base section of the plug-in connector.

12. A method for producing a control apparatus according to claim 4, the method comprising:

providing a semi-finished product including the plug-in connector inserted into the opening in the housing;

orienting the semi-finished product with the plug-in connector arranged underneath the housing in a direction of a force of gravity, resulting in the one or more contact pins of the plug-in connector, with which contact is to be made by a complementary plug from outside the control apparatus, to point downwards;

applying a fluid sealing compound to the base section of the plug-in connector from the interior of the housing and through the opening, to cause the sealing compound to run into and fill an intermediate space formed in the groove between the collar of the housing and the wall of the groove, until a level of the base section is reached.

13. The method according to claim 12, which comprises continuing the step of applying the fluid sealing compound after the level of the base section has been reached, until the sealing compound extends from the groove via the base section to the contact pin, and with the result that the sealing compound covers the base section in certain locations and surrounds the contact pin laterally.

14. The method according to claim 13, which comprises applying the fluid sealing compound until the sealing compound covers the base section completely.

* * * * *